US010421276B2

(12) United States Patent
Saito et al.

(10) Patent No.: US 10,421,276 B2
(45) Date of Patent: Sep. 24, 2019

(54) PRINTING ELEMENT SUBSTRATE AND LIQUID EJECTION HEAD

(71) Applicant: CANON KABUSHIKI KAISHA, Tokyo (JP)

(72) Inventors: Akiko Saito, Tokyo (JP); Shintaro Kasai, Yokohama (JP); Yoshiyuki Nakagawa, Kawasaki (JP); Takatsugu Moriya, Tokyo (JP); Koichi Ishida, Tokyo (JP); Tatsuya Yamada, Kawasaki (JP); Shuzo Iwanaga, Kawasaki (JP); Ayako Iwasaki, Yokohama (JP); Tomoki Ishiwata, Kawasaki (JP); Tomohiro Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 15/595,541

(22) Filed: May 15, 2017

(65) Prior Publication Data

US 2017/0341388 A1 Nov. 30, 2017

(30) Foreign Application Priority Data

May 27, 2016 (JP) ..... 2016-106222

(51) Int. Cl.
*B41J 2/14* (2006.01)
*B41J 2/16* (2006.01)

(52) U.S. Cl.
CPC ..... *B41J 2/1433* (2013.01); *B41J 2/1404* (2013.01); *B41J 2/164* (2013.01); *B41J 2/1631* (2013.01); *B41J 2202/11* (2013.01)

(58) Field of Classification Search
CPC ..... B41J 2/1433
See application file for complete search history.

(56) References Cited

U.S. PATENT DOCUMENTS

2007/0076053 A1* 4/2007 Hart ..... B41J 2/1603 347/47
2014/0125735 A1* 5/2014 Takei ..... B41J 2/1404 347/44
2018/0086076 A1* 3/2018 McMullen ..... B41J 2/14233

FOREIGN PATENT DOCUMENTS

JP 2013000914 A 1/2013

* cited by examiner

*Primary Examiner* — Kristal Feggins
*Assistant Examiner* — Kendrick X Liu
(74) *Attorney, Agent, or Firm* — Canon U.S.A., Inc. IP Division

(57) ABSTRACT

A printing element substrate includes a substrate, an energy generating element, and an ejection-port formed member. The energy generating element is disposed on one surface of the substrate and configured to generate energy for use in ejecting liquid. The ejection-port formed member includes ejection ports that eject the liquid. A protrusion protruding toward inside of each of the ejection ports is provided on an inner surface of the ejection port. In a surface of the ejection-port formed member remote from the substrate, a tip portion of the protrusion is positioned closer to the substrate than an outer periphery of the ejection port.

15 Claims, 10 Drawing Sheets

| | (1) | (2) | (3) | (4) |
|---|---|---|---|---|
| SCHEMATIC DIAGRAM OF EJECTION PORT |   |   |   |   |
| PROTRUDING DIRECTION | X | | Y | |
| ATTACHMENT POSITION | OUTER PERIPHERY | PROTRUSION | OUTER PERIPHERY | PROTRUSION |
| Y-DISPLACEMENT VALUE | 1 | 0.6 | 2.1 | 0.8 |

PRINTING ELEMENT SUBSTRATE AND LIQUID EJECTION HEAD

BACKGROUND OF THE INVENTION

Field of the Invention

The present disclosure relates to a printing element substrate and a liquid ejection head.

Description of the Related Art

In a liquid ejection apparatus that ejects liquid to perform printing or the like, the liquid ejected from ejection ports separates into a main droplet and a satellite droplet associated therewith or mist. The satellite droplet lands at a position deviated from a desired position, and the minuscule mist cannot reach a printing medium and can adhere to the liquid ejection head or the liquid ejection apparatus, possibly causing a decrease in print quality or breakdown of the apparatus. For that reason, generation of satellite droplets and mist may be reduced.

A liquid ejection head disclosed in Japanese Patent Laid-Open No. 2013-914 includes protrusions on the inner surface of each of ejection ports that eject liquid to increase the meniscus between the protrusions to thereby decrease tailing of the ejected droplets, thereby reducing generation of mist.

However, in the liquid ejection head disclosed in Japanese Patent Laid-Open No. 2013-914, a wiping operation of wiping liquid droplets or foreign substances adhering to the surface of an ejection-port formed member can deform or break the protrusions as the wiping member comes into contact with the protrusions.

Japanese Patent Laid-Open No. 2013-914 also discloses forming each ejection port in a recessed portion that is recessed from the surface of the ejection-port formed member. In this case, the wiping member hardly comes into contact with the protrusions, and therefore the protrusions are hard to break. However, forming an ejection port in a recessed portion makes it difficult for the wiping member to come into contact with not only the protrusions but also the outer periphery of the ejection port, therefore making it difficult to remove liquid droplets or foreign substances adhering to the vicinity of the ejection port.

SUMMARY OF THE INVENTION

The present disclosure provides a printing element substrate having protrusions for preventing generation of mist in which the protrusions are hard to break and in which liquid droplets and foreign substances adhering to the outer peripheries of ejection ports can be removed as well as a liquid ejection head including the same.

A printing element substrate according to a first aspect of the present disclosure includes a substrate, an energy generating element, and an ejection-port formed member. The energy generating element is disposed on one surface of the substrate and configured to generate energy for use in ejecting liquid. The ejection-port formed member includes ejection ports that eject the liquid. A protrusion protruding toward inside of each of the ejection ports is provided on an inner surface of the ejection port. In a surface of the ejection-port formed member remote from the substrate, a tip portion of the protrusion is positioned closer to the substrate than an outer periphery of the ejection port.

A liquid ejection head according a second aspect of the present disclosure includes the above-described printing element substrate.

Further features and aspects of the present disclosure will become apparent from the following description of various example embodiments with reference to the attached drawings.

DESCRIPTION OF THE EMBODIMENTS

Various example embodiments of the disclosure will be described with reference to the accompanying drawings. In the specification and the drawings, components having the same function may be denoted by the same reference signs, and redundant descriptions may be omitted.

First Example Embodiment

Example Configuration of Liquid Ejection Head

Figure 1:
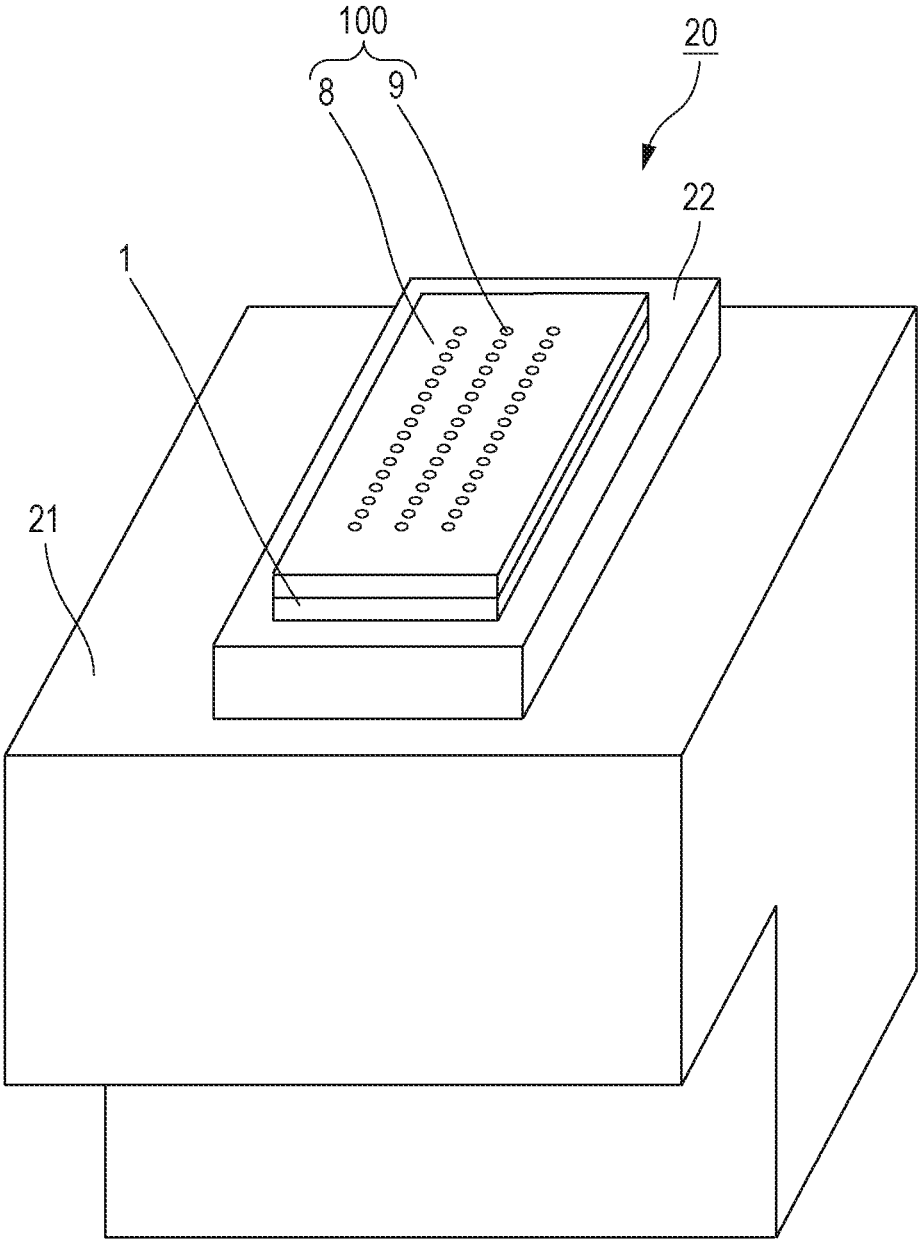
FIG. 1 is a perspective view illustrating a configuration of a liquid ejection head according to a first example embodiment of the disclosure.

FIG. 1 is a perspective view illustrating, in outline, the configuration of a liquid ejection head 20 including a printing element substrate 100 according to a first example embodiment of the disclosure.

The liquid ejection head 20 includes the printing element substrate 100, a head main body 21, and a connecting member 22. The printing element substrate 100 includes a substrate 1 and an ejection-port formed member 8. The ejection-port formed member 8 has a plurality of ejection ports 9. The printing element substrate 100 is mounted on the head main body 21 via the connecting member 22. The liquid ejection head 20 is mounted on a liquid ejection apparatus (not shown) and ejects liquid, such as ink, from the ejection ports 9 to perform various processes, such as printing, on a printing medium (not shown).

Example Configuration of Printing Element Substrate

Figure 2A:
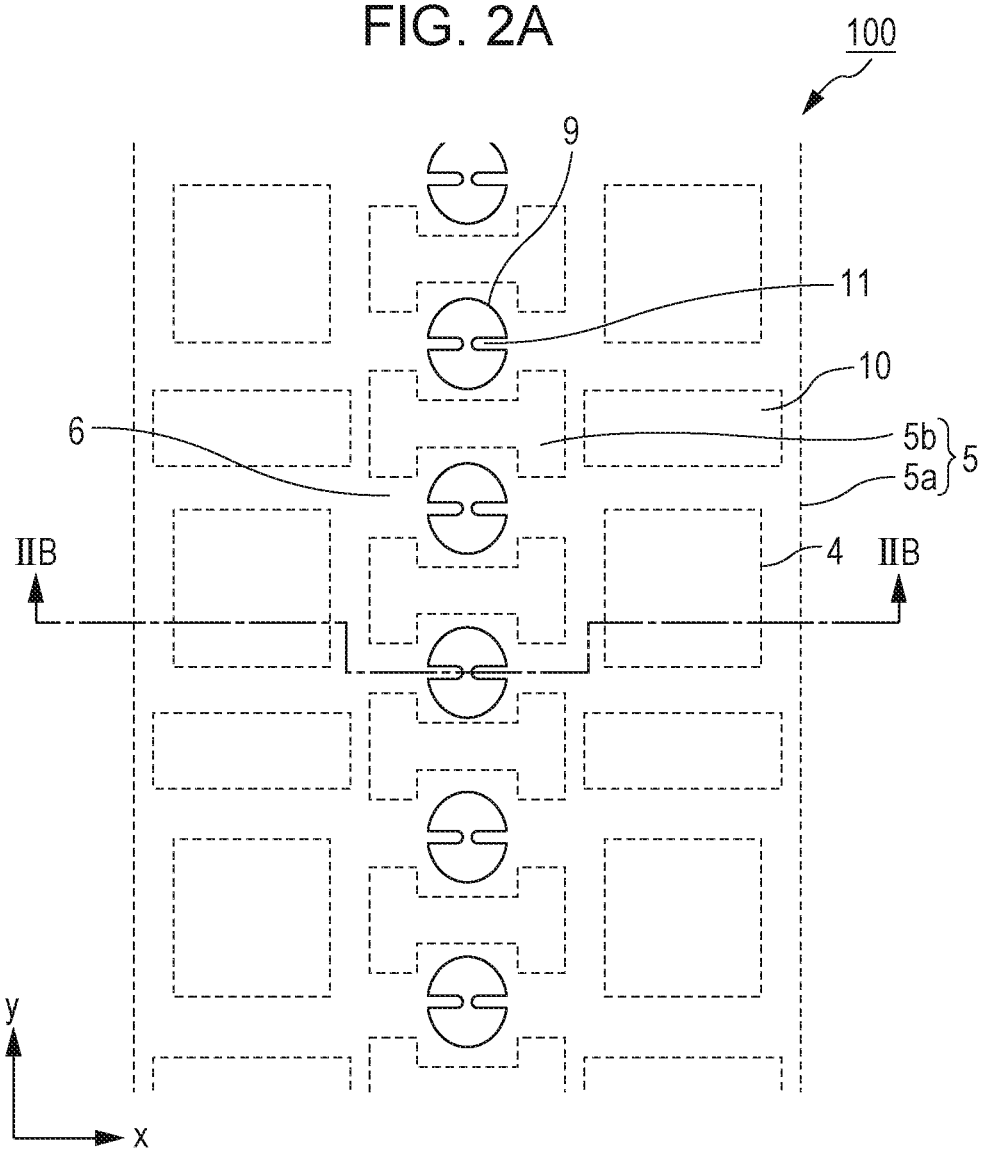
FIG. 2A is a schematic transparent view of an example printing element substrate illustrating the planar configuration.
Figure 2B:
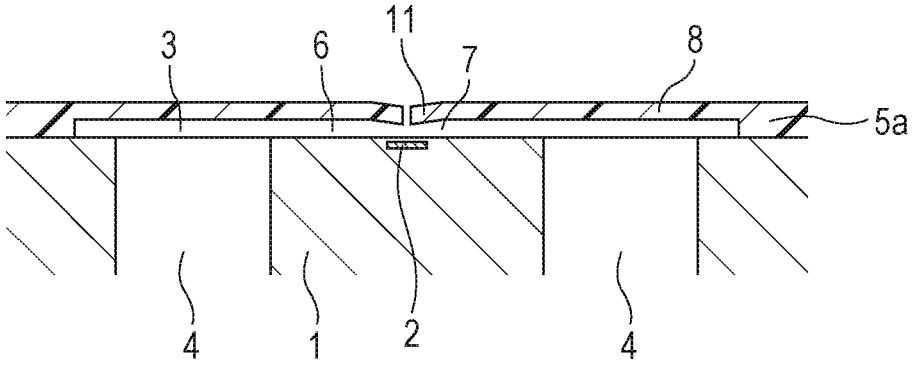
FIG. 2B is a cross-sectional view taken along line IIB-IIB of FIG. 2A.

FIGS. 2A and 2B are diagrams illustrating an example configuration of the printing element substrate 100. FIG. 2A is a schematic transparent view of the printing element substrate 100 illustrating the planar configuration. FIG. 2B is a cross-sectional view taken along line IIB-IIB of FIG. 2A.

A channel forming member 5 and the ejection-port formed member 8 are disposed in layers on the substrate 1. Energy generating elements 2 are disposed at positions corresponding to the plurality of ejection ports 9 disposed in the ejection-port formed member 8 on the substrate 1. The energy generating elements 2 generate energy for ejecting liquid. The channel forming member 5 includes a channel-wall member 5*a* that forms a channel wall and partition members 5*b* that each form a partition wall for separating adjacent energy generating elements 2 from each other. Between the adjacent partition members 5*b*, a pressure chamber 7 including the energy generating element 2 therein and channels 6 that supply liquid to the pressure chamber 7 are provided. Between the channel-wall member 5*a* and the partition member 5*b*, a common liquid chamber 3 communicating with the channels 6 is provided. A direction in which the energy generating elements 2 are arranged in line, that is, a direction in which the ejection ports 9 are arrayed, is referred to as y-direction, and an in-plane direction that is parallel to a surface of the substrate 1 and is perpendicular to the y-direction is referred to as x-direction. In this case, one channel 6 extends in the x-direction on each side of the pressure chamber 7, and the common liquid chamber 3 communicating with the channels 6 is disposed outside the channels 6 in the x-direction. The substrate 1 has supply passages 4 passing therethrough in the thickness direction. The supply passages 4 communicate with the common liquid chamber 3. In the present embodiment, the common liquid chamber 3 communicates with the two channels 6. Although not illustrated in FIG. 1, a filter member may be disposed in a passage in which liquid flows from the supply passages 4 to the pressure chamber 7, for example, the channels 6, to prevent dust or the like from entering the pressure chamber 7. The supply passages 4 are disposed in one surface of the substrate 1 in such a manner that openings are arranged in the y-direction. Between the openings of the supply passages 4 adjacent in the y-direction, a support member 10 that supports the ejection-port formed member 8 is disposed. The above configuration allows the printing element substrate 100 to supply liquid from both sides of the pressure chamber 7. This increases the liquid supply speed, allowing high-speed printing. Supplying liquid from both sides of the pressure chamber 7 enhances the symmetry of the flow of the liquid around the ejection port 9 to improve the straightness of the ejected liquid, easily making the ejected liquid land on a desired position on the printing medium.

The ejection ports 9 are disposed at an interval of 600 dpi in the y-direction. The openings of the supply passages 4 in one surface of the substrate 1 are disposed at an interval of 300 dpi in the y-direction, that is, parallel to the ejection ports 9. The openings of the supply passages 4 are each 40 μm in length in the x-direction and the y-direction. The dimensions of the ejection ports 9 are 20.5 μm in the y-direction, and 20 μm in the x-direction. The thinner the ejection-port formed member 8, the lower the viscosity resistance that the liquid receives, so that, even if the moisture in the liquid evaporates from the ejection ports 9 to increase the viscosity of the liquid, increasing the viscosity resistance, the liquid droplets can easily be ejected. The thickness of the ejection-port formed member 8 is preferably in the range of 10 μm or less and 3 μm or more. The thickness within the range allows both of ease of ejection and the strength of the ejection-port formed member 8 to be achieved. The height of the pressure chamber 7 is preferably about 16 μm or less to enhance the coherence of the liquid droplets. In the present embodiment, the thickness of the ejection-port formed member 8 is 4.5 μm, and the height of the pressure chamber 7 from the substrate 1 to a surface of the ejection-port formed member 8 adjacent to the substrate 1 is 5.0 μm. Therefore, the distance from the surface of the substrate 1 in which the energy generating elements 2 are disposed to the surface of the ejection-port formed member 8 remote from the substrate 1 is 9.5 μm. If the pressure chamber 7 is low in height, the liquid supply speed to the pressure chamber 7 could decrease. However, the present embodiment prevents a decrease in the supply speed by supplying the liquid from both sides of the pressure chamber 7, as described above.

Example Configuration of Ejection Ports

Figure 3A:
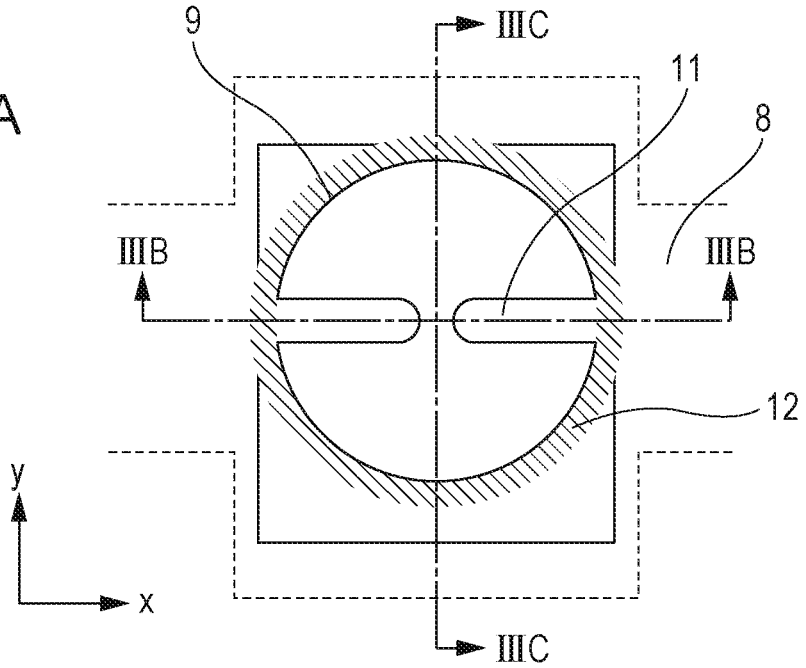
FIG. 3A is a diagram illustrating the planar configuration of an ejection port in FIGS. 2A and 2B.
Figure 3B:
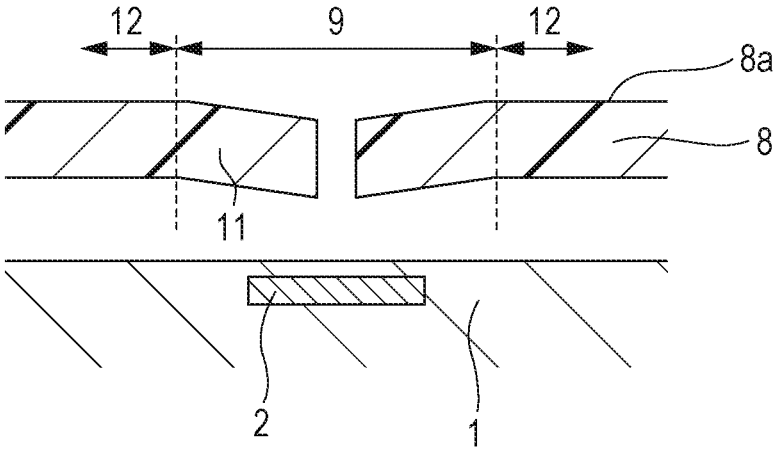
FIG. 3B is a cross-sectional view taken along IIIB-IIIB of FIG. 3A.
Figure 3C:
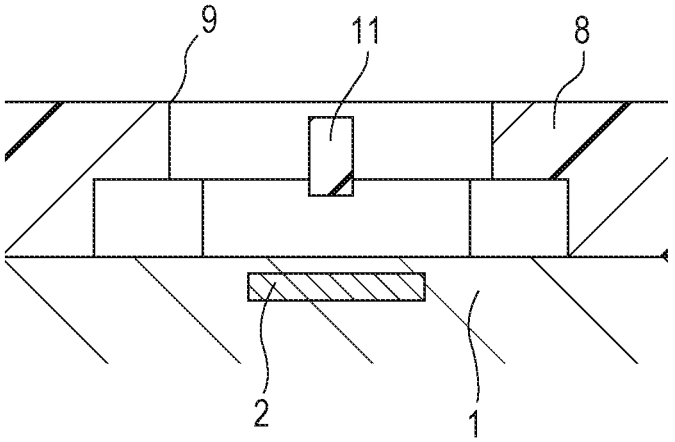
FIG. 3C is a cross-sectional view taken along IIIC-IIIC of FIG. 3A.

FIGS. 3A to 3C illustrate the detailed configuration of the ejection port 9 in FIG. 2A. FIG. 3A is a diagram illustrating the planar configuration of the ejection port 9. FIG. 3B is a cross-sectional view taken along IIIB-IIB of FIG. 3A. FIG. 3C is a cross-sectional view taken along IIIC-IIIC of FIG. 3A.

The ejection port 9 is a through-hole passing through the ejection-port formed member 8. The ejection port 9 has protrusions 11 that protrude toward the inside of the ejection port 9. An outer periphery 12 of the ejection port 9 is a portion enclosing the opening of the ejection port 9. A surface 8*a* of the ejection-port formed member 8 remote from the substrate 1 is flat. Therefore, the outer periphery 12 is flush with the surface 8*a* of the ejection-port formed member 8. The tip portions of the protrusions 11 are positioned closer to the substrate 1 than the ejection-port formed member 8. Therefore, the tip portions of the protrusions 11 are closer to the substrate 1 than the outer periphery 12 of the ejection port 9. The base portions of the protrusions 11 in contact with the inner surface of the ejection port 9 is flush with the outer periphery 12, and the protrusions 11 are inclined to the substrate 1 from the surface 8*a* of the ejection-port formed member 8 with increasing distance from the base portions to the tip portions.

The protrusions 11 extend in the x-direction illustrated in FIG. 2A, that is, in a direction perpendicular to the direction in which the ejection ports 9 are arranged. In the present embodiment, the width of each protrusion 11 is 2 μm, and the interval between the protrusions 11 is 3 μm. A pair of protrusions 11 are disposed on both sides of the ejection port 9. One protrusion 11 is 8.5 μm in length. This configuration makes the distance between the protrusions 11 small to enhance the coherence of the ejected liquid droplets, thereby reducing the amount of scattering mist.

Example Method for Manufacturing Printing Element Substrate

FIGS. 4A to 4H are diagrams illustrating an example method for manufacturing the printing element substrate 100. FIGS. 4A to 4H illustrate a process for manufacturing the printing element substrate 100 in sequence.

Figure 4A:
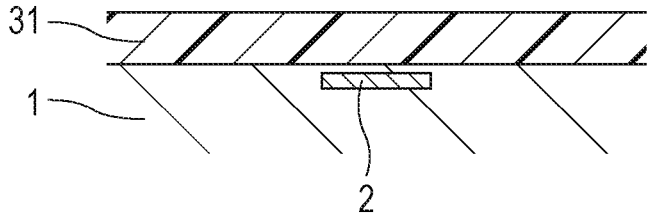
FIGS. 4A to 4H are diagrams illustrating an example method for manufacturing a printing element substrate.

Referring first to FIG. 4A, film of a first negative photosensitive resist 31 is formed on the substrate 1 in which the energy generating elements 2 are disposed. The first negative photosensitive resist 31 may be a chemically amplified resist. Examples of a resin component contained in the first negative photosensitive resist 31 include epoxy resins, silicon-based polymer compounds, and vinyl-based polymer compounds having a hydrogen atom at α-position. Among the above resin components, epoxy resins may be used. The first negative photosensitive resist 31 can contain a photoacid generator. Examples of the photoacid generator include triarylsulfonium salt and onium salt. The first negative photosensitive resist 31 may contain a solvent. Example of the solvent include propylene glycol monomethylether acetate (hereinafter referred to as PGMEA) and γ-butyrolactone. Examples of a method for forming the film of the first negative photosensitive resist 31 include a method of solvent coating and a method of forming a dry film and transferring it onto a substrate. The film thickness of the first negative photosensitive resist 31 is not particularly limited but may be, for example, 5 μm or more and 30 μm or less.

Figure 4B:
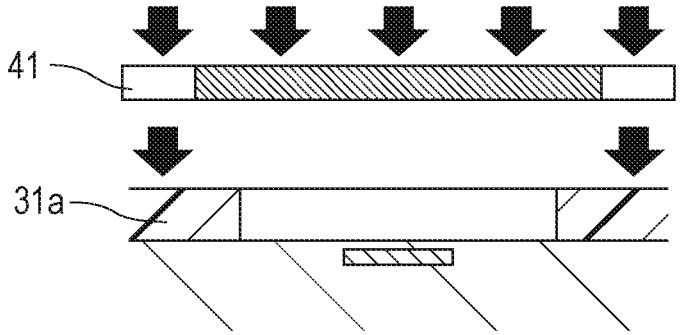

Referring next to FIG. 4B, the first negative photosensitive resist 31 is selectively exposed to light via a mask 41 to form a latent image of a liquid channel pattern and performs post exposure bake (hereinafter referred to as PEB). Since the present embodiment uses a negative resist, the mask 41 is patterned to the shapes of the channel forming member 5 and the support member 10 so as to expose only a portion to be left as a channel wall. A cured portion 31*a* of the first negative photosensitive resist is formed by this process. For the exposure, for example, ultraviolet light or ionizing radiation can be used. The amount of exposure may be, for example, 3,000 J/m$^2$ or more and 10,000 J/m$^2$ or less. The temperature of the PEB may be, for example, 40° C. or more, and 105° C. or less. The time period of the PEB may be, for example, three minutes or more and 15 minutes or less. The conditions shown here are given for mere examples and may be any conditions under which a desired pattern can be formed.

Figure 4C:
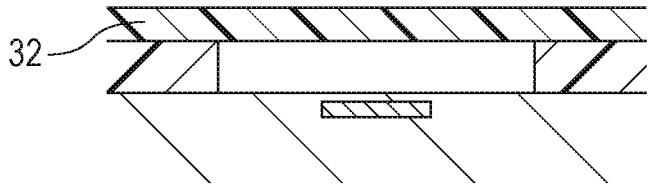

After the cured portion 31*a* of the first negative photosensitive resist 31 has been formed, film of a second negative photosensitive resist 32 is formed on the first negative photosensitive resist 31, as illustrated in FIG. 4C. The second negative photosensitive resist 32 may be a chemically amplified resist. A resin component contained in the second negative photosensitive resist 32 may be the same as that of the first negative photosensitive resist 31, such as epoxy resins, silicon-based polymer compounds, and vinyl-based polymer compounds having a hydrogen atom at α-position. The second negative photosensitive resist 32 may contain a photoacid generator. The photoacid generator may be the same as that in the first negative photosensitive resist 31, such as triarylsulfonium salt and onium salt. The second negative photosensitive resist 32 may contain a solvent. The solvent may be the same as that in the first negative photosensitive resist 31, such as PGMEA and γ-butyrolactone.

To form a latent image of a channel pattern formed using the cured portion 31*a* of the first negative photosensitive resist 31, the exposure sensitivity of the second negative photosensitive resist 32 may be higher than the exposure sensitivity of the first negative photosensitive resist 31. For that purpose, the second negative photosensitive resist 32 may contain much more photoacid generator than the first negative photosensitive resist 31. Examples of a method for forming the film of the second negative photosensitive resist 32 include a method of solvent coating and a method of forming a dry film and transferring it onto a substrate. Between them, the film of the second negative photosensitive resist 32 may be formed using the method of forming a dry film and transferring it onto the substrate 1. This is because, if the solvent coating method is used, a solvent contained in the second negative photosensitive resist 32 can dissolve the first negative photosensitive resist 31. The film thickness of the second negative photosensitive resist 32 is not particularly limited. For example, the thickness may be 3 μm or more and 60 μm or less.

Figure 4D:
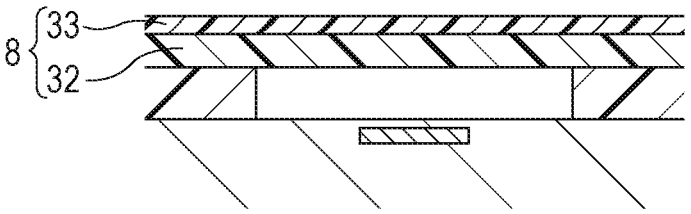

After the film of the second negative photosensitive resist 32 has been formed, film of a third negative photosensitive resist 33 is formed as a water repellent layer on the film of the second negative photosensitive resist 32, as illustrated in FIG. 4D. The third negative photosensitive resist 33 may be a chemically amplified resist. A resin component contained in the third negative photosensitive resist 33 may be different from the resin components contained in the first negative photosensitive resist 31 and the second negative photosensitive resist 32. The third negative photosensitive resist 33 may contain a photoacid generator. The photoacid generator may be any photoacid generator that can form a desired patter and may be the same as those of the first negative photosensitive resist 31 and the second negative photosensitive resist 32. The third negative photosensitive resist 33 may further contain a solvent. The third negative photosensitive resist 33 may contain either one kind of solvent or two or more kinds of solvent. Examples of the solvent include ethanol and butanol. The boiling point of the solvent (if two or more kinds are used, a mixed solvent) is preferably 150° C. or less to prevent the solvent from penetrating into the first negative photosensitive resist 31. The solvent contained in the third negative photosensitive resist 33 may be the same as those contained in the first negative photosensitive resist 31 and the second negative photosensitive resist 32. Examples of a method for forming the film of the third negative photosensitive resist 33 include a method of solvent coating and a method of forming a dry film and transferring it onto a substrate. The film thickness of the third negative photosensitive resist 33 is not particularly limited but may be, for example, 0.1 μm or more and 3 μm or less.

Figure 4E:
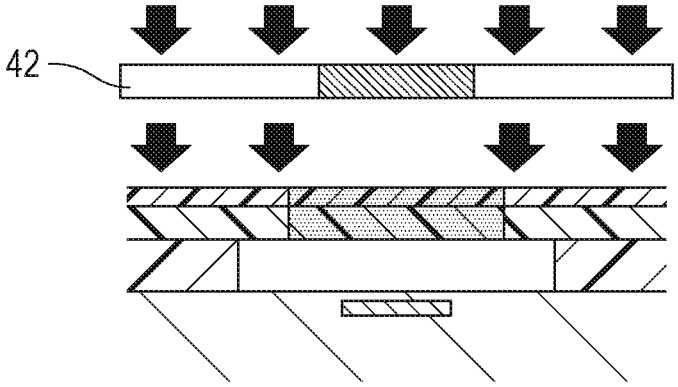

Referring next to FIG. 4E, the films of the second negative photosensitive resist 32 and the third negative photosensitive resist 33 are selectively exposed to light in a lamp via a mask 42 to form a latent image of a pattern along the shapes of the ejection ports 9 (see FIG. 2A), and are then subjected to PEB. For example, ultraviolet light or ionizing radiation can be used. The amount of exposure may be, for example, 400 J/m$^2$ or more and 3,000 J/m$^2$ or less. The temperature of the PEB may be, for example, 70° C. or more and 105° C. or less. The time period of the PEB may be, for example, three minutes or more and 10 minutes or less. The conditions shown here are given for mere examples and may be any conditions under which a desired pattern can be formed.

Figure 4F:
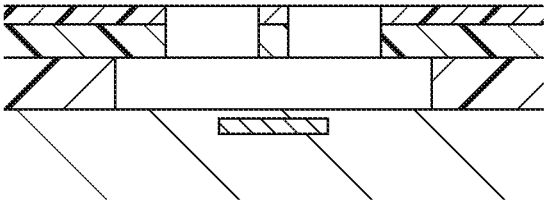

Furthermore, as illustrated in FIG. 4F, the first negative photosensitive resist 31, the second negative photosensitive resist 32, and the third negative photosensitive resist 33 are collectively developed to form the channel of the liquid (the common liquid chamber 3, the channels 6, and the pressure chamber 7 in FIG. 2B) and the ejection ports 9. The development may be performed using PGMEA or the like.

Figure 4G:
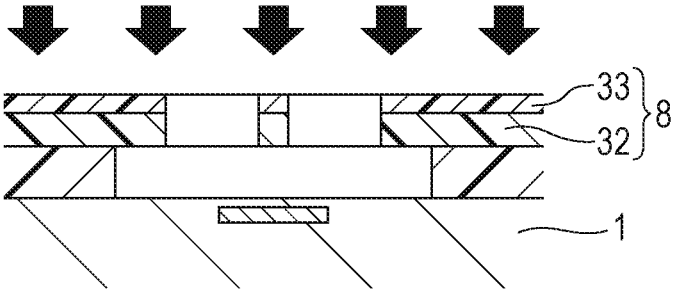

After the development, the channel of the liquid and the ejection ports 9 are exposed, as illustrated in FIG. 4G. This exposing process is performed to cause ring opening of the epoxy group of the second negative photosensitive resist 32 and the third negative photosensitive resist 33. For the exposure, for example, ultraviolet light or ionizing radiation can be used. The amount of exposure may be, for example, 400 J/m$^2$ or more and 3,000 J/m$^2$ or less.

Figure 4H:
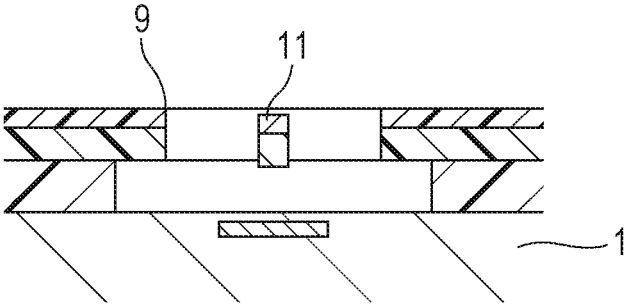

Referring next to FIG. 4H, heat treatment is performed. The heat treatment deforms the protrusions 11 of the ejection-port formed member 8 due to the difference in cure shrinkage between the second negative photosensitive resist 32 and the third negative photosensitive resist 33. For example, when the cure shrinkage of the third negative photosensitive resist 33 is smaller than that of the second negative photosensitive resist 32, the tip portions of the protrusions 11 of the ejection-port formed member 8 are deformed toward the substrate 1 after heat treatment. The ring opening of the epoxy group of the second negative photosensitive resist 32 and the third negative photosensitive resist 33 can be controlled by the exposure dose of the exposure process illustrated in FIG. 4G, so that the deformation amount of the protrusions 11 can be controlled. The temperature of the heat treatment may be, for example, 160° C. or more and 250° C. or less, and the time period of the heat treatment may be, for example, 30 minutes or more and five hours or less. The shape of the protrusions 11 can be controlled by varying conditions for the exposure process and the heat treatment.

That is one example of a method for manufacturing the printing element substrate 100. This method allows the tip portions of the protrusions 11 to be located closer to the substrate 1 than the ejection-port formed member 8 by forming the ejection-port formed member 8 made of the layers of two or more kinds of material having different cure shrinkage characteristics and deforming the protrusions 11 using an exposure process and heat treatment.

In the above example, the ejection-port formed member 8 is formed with the second negative photosensitive resist 32 and the third negative photosensitive resist 33, but the present disclosure is not limited to this example. For example, a water-repellant solvent may be applied to the second negative photosensitive resist 32 instead of the third negative photosensitive resist 33, and the collective development in FIG. 4F may be performed to form a water repellent layer on the surface layer of the second negative photosensitive resist 32. The thickness of the water repellent layer may be, for example, 0.1 μm or more and 3 μm or less.

In the printing element substrate 100, the tip portions of the protrusions 11 are positioned closer to the substrate 1 with respect to the surface 8*a* of the ejection-port formed member 8. This reduces the possibility that a wiping member, such as a blade, comes into contact with the protrusions 11 even if a wiping operation of wiping the surface 8*a* of the ejection-port formed member 8 with the wiping member is performed, reducing the possibility of breakage, such as breakage of the protrusions 11. In particular, the thickness of the ejection-port formed member 8 is as thin as 4.5 μm, and the strength of the printing element substrate 100 against an external force decreases as the thickness of the ejection-port formed member 8 decreases. For that reason, it is particularly effective to reduce the possibility that the protrusions 11 come into contact with the wiping member, thereby making the protrusions 11 hard to break. Furthermore, only the tip portions of the protrusions 11 are positioned closer to the substrate 1 than the surface 8*a* of the ejection-port formed member 8, and the outer peripheries 12 of the ejection ports 9 are flush with the surface 8*a* of the ejection-port formed member 8. This allows deposit, such as liquid droplets, adhering to the outer peripheries 12 to be removed at the wiping operation. In the field of liquid ejection apparatuses, ink that contains a lot of solid content has recently been used to form higher quality images with better coloring and stability. For example, when an ink having a solid content concentration (coloring material concentration) of 8.0% by weight or more is used, deposit tends to be generated.

Figure 5A:
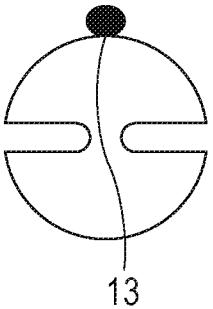
FIGS. 5A and 5B are diagrams for explaining an effect of the disclosure.
Figure 5A:
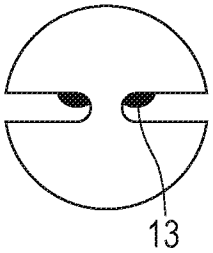
Figure 5A:
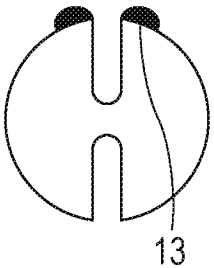
Figure 5A:
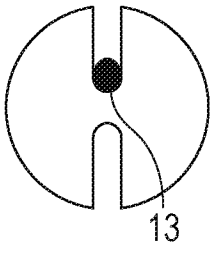
Figure 5B:
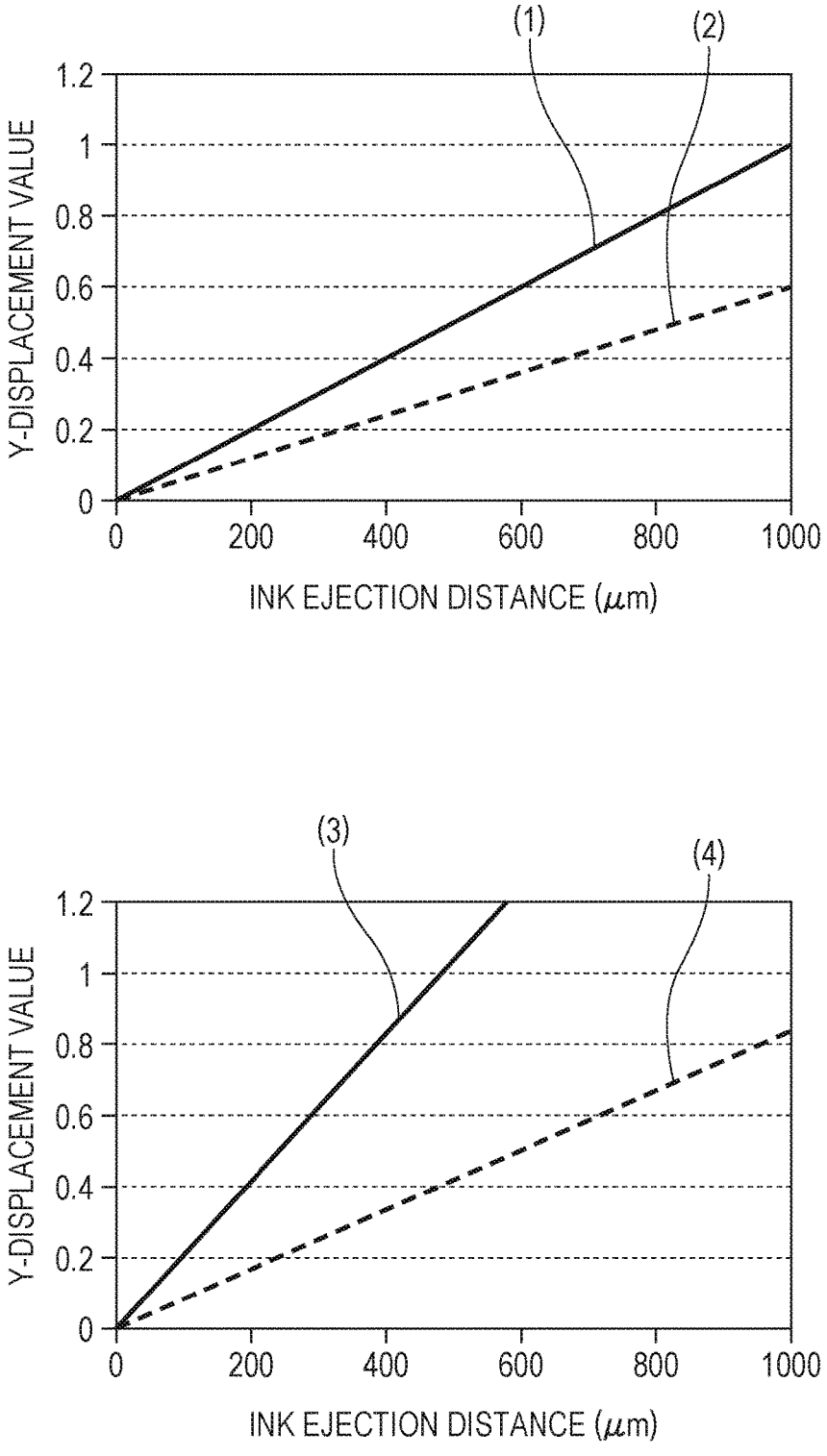

FIGS. 5A and 5B illustrate the attachment position of deposit 13 around the ejection port 9 and the displacement amount of the position where the liquid droplets land at that time. FIG. 5A illustrates Examples (1) to (4) in which the combination of a direction in which the protrusions 11 of the ejection port 9 protrude and the attachment position of the deposit 13 differ. FIG. 5B illustrates changes in Y-displacement value, which is the value of displacement of the landing positions of the liquid droplets in Examples (1) to (4) of FIG. 5A from an ideal landing position, with respect to liquid ejection distance. The Y-displacement value is standardized so as to be 1 when the liquid ejection distance is 1 mm in Example (1). The table of FIG. 5A illustrates, as the Y-displacement value, values when the liquid ejection distance is 1 mm.

In Example (1) and Example (2) of FIG. 5A, the protrusions 11 of the ejection port 9 protrude in the x-direction, and in Example (3) and Example (4), the protrusions 11 protrude in the y-direction. In Example (1) and Example (3), the deposit 13 adheres to the outer periphery 12, and in Example (2) and Example (4), the deposit 13 adheres to the protrusions 11. The schematic diagrams of the ejection port in FIG. 5A illustrate the attachment positions of the deposit 13. A simulation in which liquid is ejected in the states illustrated in these schematic diagrams was performed to find the Y-displacement value indicating the displacement amount of the landing position of the ejected liquid droplets from the ideal landing position. When the liquid ejection distance is 1 mm, the Y-displacement value was 1 in Example (1), 0.6 in Example (2), 2.1 in Example (3), and 0.8 in Example (4). A comparison in the case where the protrusions protrude in the same direction showed that the Y-displacement value is larger when the deposit 13 attaches to the outer periphery 12 of the ejection port 9 than that when the deposit 13 attaches to the protrusions 11. A comparison in the case where the attachment positions of the deposit 13 are the same showed that the Y displacement value is larger when the protrusions 11 are in the y-direction than in the x-direction. Therefore, the protrusions 11 may be in the x-direction, as illustrated in FIG. 2A, so that the Y-displacement value can be small. In the printing element substrate 100, the deposit 13 on the outer periphery 12 whose displacement of landing position from an ideal landing position is large can be removed by a wiping operation. This can reduce influences on the print image, providing a high-definition, high-quality image with stability.

Second Example Embodiment

Figure 6:
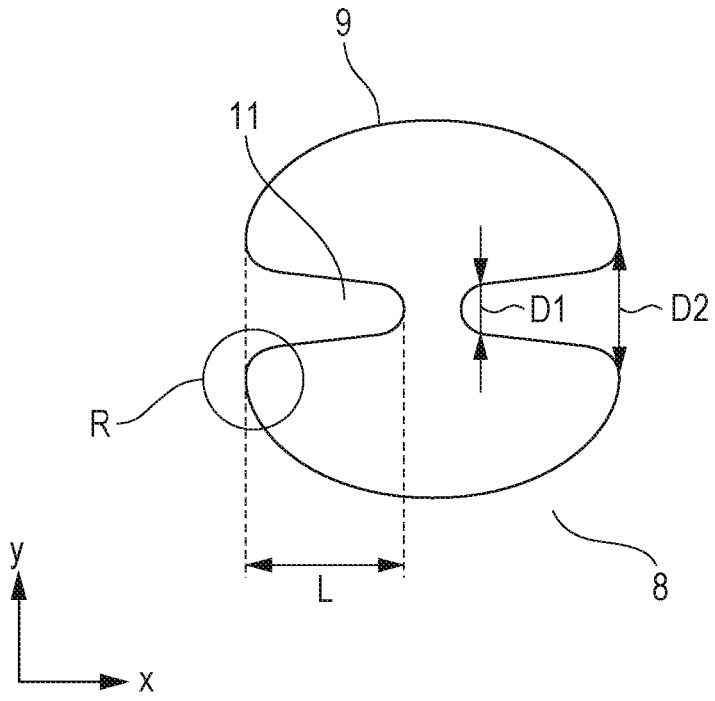
FIG. 6 is a diagram illustrating the shape of an ejection port according to a second example embodiment of the disclosure.

FIG. 6 is a schematic diagram illustrating the shape of an ejection port 9 of a printing element substrate 200 (not shown) according to a second example embodiment of the disclosure. Since the basic configuration of the printing element substrate 200 is the same as the configuration of the printing element substrate 100 according to the first embodiment, a description will be omitted, and differences from the printing element substrate 100 will be mainly described.

The printing element substrate 200 differs from the printing element substrate 100 in the shape of the ejection port 9. In the present embodiment, the ejection port 9 is larger in the width D2 of each of the base portions of the protrusions 11 in contact with the inner surface of the ejection port 9 than the width D1 of each of the tip portions of the protrusions 11. The base portions of the protrusions 11 are curved. A stress against an external force tends to focus on the base portions of the protrusion 11. For that reason, the strength of the protrusions 11 can be increased by increasing the width D2 of each base portion. The coherence of the ejected liquid droplets can be improved by making the width D1 of each tip portion of the protrusions 11 smaller than the width D2.

As in the first embodiment, a direction in which the ejection ports 9 are arrayed is referred to as y-direction, and an in-plane direction that is parallel to a surface of the substrate 1 and is perpendicular to the y-direction is referred to as x-direction. The protrusions 11 of the printing element substrate 200 also protrude in the x-direction. The width D1 of the tip portions of the protrusions 11 is 2 μm, and the width D2 of each of the base portions of the protrusions 11 is 4 μm. The curvature radius R of each of the base portions of the protrusions 11 is 4 μm. The distance between a pair of protrusions 11 provided at the same ejection port 9 is 3 μm. The major axis of the ejection port 9 (the length in the y-direction) is 20.5 μm, and the minor axis (the length in the x-direction) is 20 μm. The length of each protrusion 11 is 8.5 μm. Increasing the thickness of base portions of the protrusions 11 increases the strength against an external force. However, the ratio of the length L of the protrusion 11 to the width D2 of the base portion, L/D2, is 2 or higher, resulting in a high aspect ratio. As a result, if an external force from the wiping member or the like is exerted on the protrusions 11, the protrusions 11 can be broken only by devising the shape of the protrusions 11. For that reason, the tip portions of the protrusions 11 of in the present embodiment are also positioned closer to the substrate 1 than the ejection-port formed member 8, as in the first embodiment. This more reliably reduces or eliminates breakage of the protrusions 11 by preventing stress concentration by increasing the thickness of the base portions of the protrusions 11 while preventing the wiping member from coming into contact with the protrusions 11. Thus, high-definition, high-quality images can be provided with stability.

Third Example Embodiment

Figure 7A:
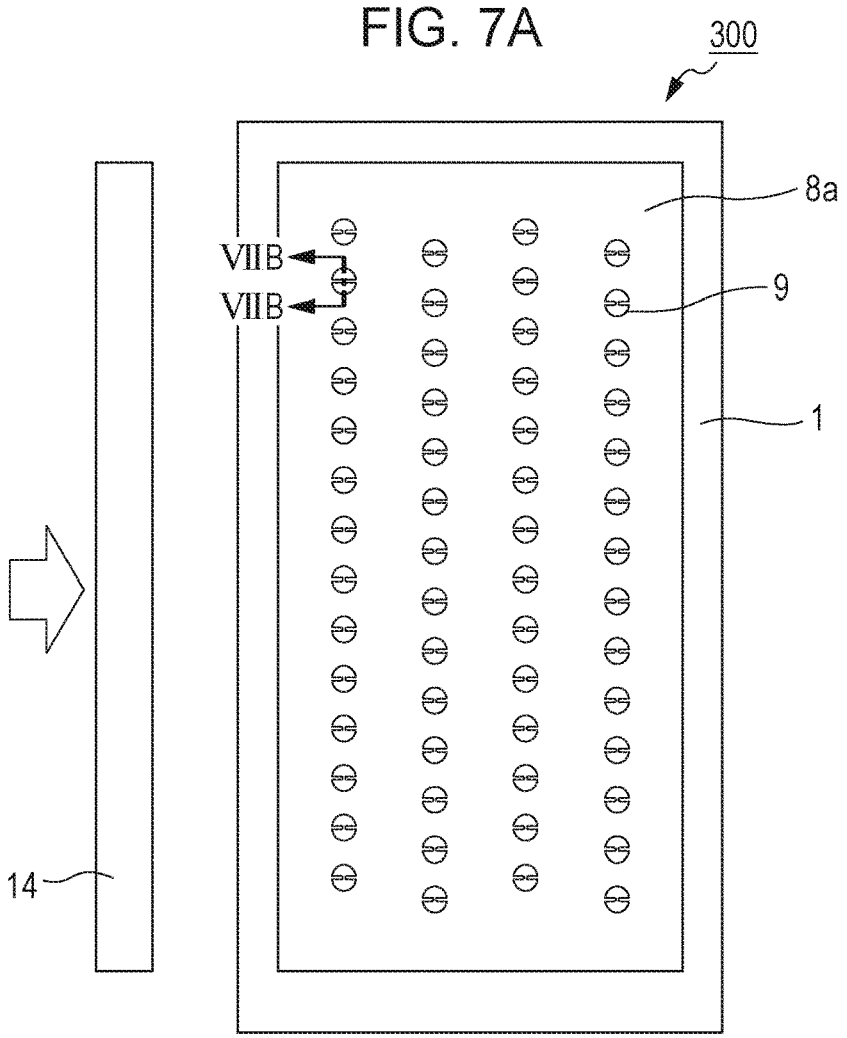
FIG. 7A is a diagram illustrating the schematic configuration of a printing element substrate and a wiping member according to a third example embodiment of the disclosure.
Figure 7B:
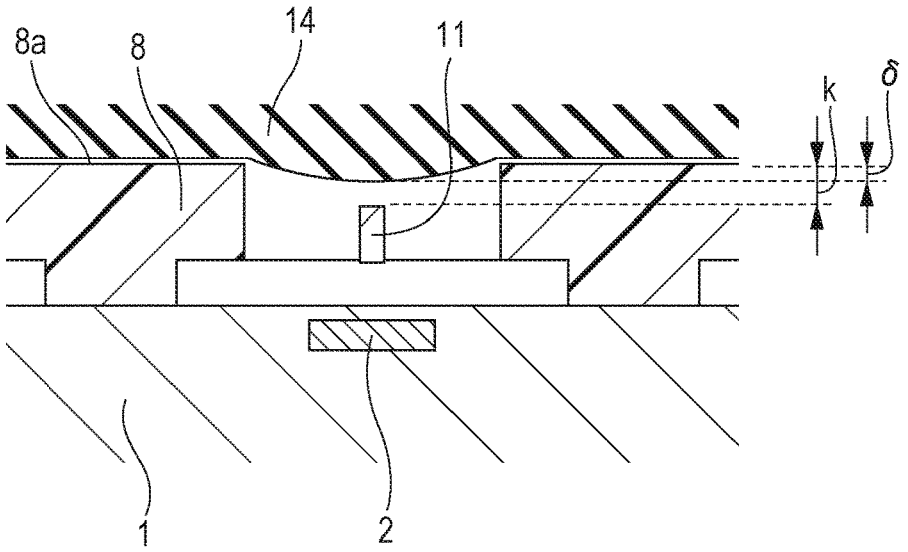
FIG. 7B is an enlarged cross-sectional view taken along line VIIB-VIIB of FIG. 7A.

FIGS. 7A and 7B are diagrams illustrating a liquid ejection apparatus including a printing element substrate 300 according to a third example embodiment of the disclosure. FIG. 7A illustrates the schematic configuration of the printing element substrate 300 and a wiping member 14 for wiping the surface 8*a* of the ejection-port formed member 8 of the printing element substrate 300. FIG. 7B is an enlarged cross-sectional view taken along line VIIB-VIIB of FIG. 7A. The wiping member 14 moves on the surface 8*a* in the direction indicated by an arrow in FIG. 7A in a state of being in contact with the surface 8*a* of the ejection-port formed member 8. This allows deposit, such as liquid, adhering to the surface 8*a* of the ejection-port formed member 8 to be removed. The wiping member 14 is an elastic member, such as rubber. A distance δ that the wiping member 14 goes into the opening of the ejection port 9 can be expressed by Exp. (1) as a simple deflection of the both-end support member under a uniformly distributed load.

$$\delta = \frac{5wL^4}{384EI} \qquad \text{Exp. (1)}$$

where E is the Young's modulus of the wiping member 14, I is the second moment of inertia of the wiping member 14, w (N/m) is a load on the wiping member 14, and L is the major axis of the ejection port 9.

To prevent the protrusions 11 from coming into contact with the wiping member 14, a distance k from the surface 8*a* of the ejection-port formed member 8 to the tip portions of the protrusions 11 is preferably set larger than the distance δ. At that time, the distance k satisfies Exp. (2).

$$k > \frac{5wL^4}{384EI} \qquad \text{Exp. (2)}$$

Since the value of the distance δ depends on the material and the shape of the wiping member 14, the shape of the protrusions 11 may be determined depending on the material and shape of the wiping member 14 using Exp. (2). Alternatively, after the shape of the protrusions 11 has been determined, the material and the shape of the wiping member 14 may be determined so as to satisfy Exp. (2).

Suppose that the Young's modulus E of the wiping member 14 is 40 MPa, the length of each of the sides of the wiping member 14 in contact with the ejection-port formed member 8 is 50 μm, the load w that the wiping member 14 applies to the ejection-port formed member 8 is 2 MPa, the entire length of the wiping member 14 is 20 mm, and the diameter L of the ejection port is 24 μm. At that time, the maximum entry distance δ of the wiping member 14 is 0.21 μm. Therefore, when the protrusions 11 is positioned 0.21 μm or more closer to the substrate 1 than the surface 8*a* of the ejection-port formed member 8, breakage of the protrusions 11 hardly occurs.

Fourth Example Embodiment

Figure 8A:
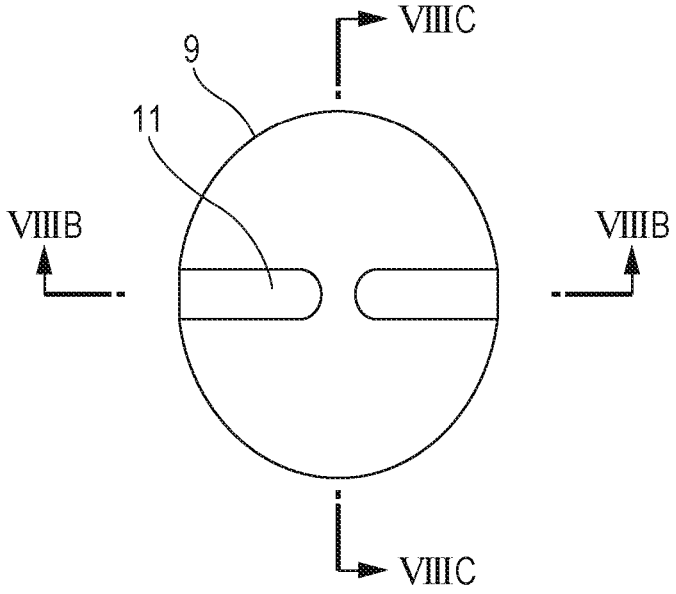
FIG. 8A is an enlarged view of an example ejection port of a printing element substrate according to a fourth example embodiment of the disclosure.
Figure 8B:
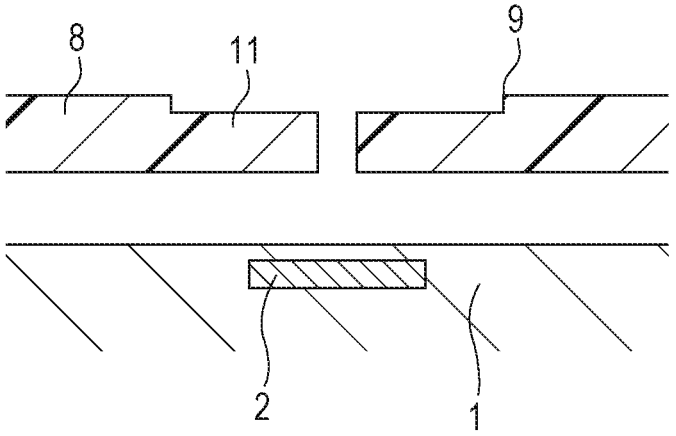
FIG. 8B is a cross-sectional view taken along line VIIIB-VIIIB of FIG. 8A.
Figure 8C:
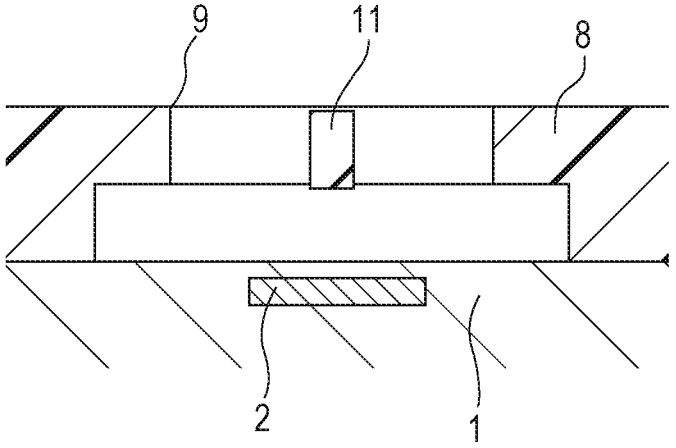
FIG. 8C is a cross-sectional view taken along line VIIIC-VIIIC of FIG. 8A.

FIGS. 8A to 8C are diagrams illustrating the configuration of a printing element substrate 400 (not shown) according to a fourth example embodiment of the disclosure. Since the overall configuration of the printing element substrate 400 is the same as the configuration of the printing element substrate 100 according to the first embodiment, a description will be omitted, and differences from the printing element substrate 100 will be mainly described.

FIG. 8A is an enlarged view of an ejection port 9 of the printing element substrate 400. FIG. 8B is a cross-sectional view taken along line VIIIB-VIIIB of FIG. 8A, and FIG. 8C is a cross-sectional view taken along line VIIIC-VIIIC of FIG. 8A. In the first to third embodiments, the base portions of the protrusion 11 are flush with the surface 8*a* of the ejection-port formed member 8, while in the present embodiment, the entire surfaces of the protrusions 11 remote from the substrate 1 are positioned in a plane different from the surface 8*a* of the ejection-port formed member 8. In this example, the surfaces of the protrusions 11 remote from the substrate 1 are positioned in a plane parallel to the surface 8*a* of the ejection-port formed member 8. This plane is positioned 1 μm closer to the substrate 1 than the surface 8*a* of the ejection-port formed member 8. Disposing the entire protrusions 11 in a plane closer to the substrate 1 than the surface 8*a* of the ejection-port formed member 8, as in the present embodiment, prevents the entire protrusions 11 from coming into contact with the wiping member 14. This further increases the flexibility of the shape of the protrusions 11 as compared with the first to third embodiments in which the wiping member 14 comes into contact with the base portions of the protrusions 11. For example, the protrusions 11 may be further increased in length, or the protrusions 11 including the base portions may be decreased in width to put emphasis on the coherence of droplets.

Having described the present disclosure with reference to the embodiments, the present disclosure is not limited to the above example embodiments. It is to be understood that various modifications will occur to those skilled in the art in the configuration and the details of the disclosure within the scope of the technical spirit of the disclosure.

For example, although the liquid ejection head 20 of the above embodiments includes the printing element substrate 100, the liquid ejection head 20 may include any one of the printing element substrates 200, 300, and 400, instead of the printing element substrate 100.

In the above embodiments, the printing element substrate has a configuration in which liquid is supplied to the pressure chamber 7 from both sides of each ejection port 9, but the disclosure is not limited to this example. The configuration other than the ejection ports 9 is given for mere illustration, and the present disclosure can be applied to printing element substrates with various configurations other than the example. For example, one of the supply passages 4 formed on both sides of each ejection port 9 may be used to supply liquid to the pressure chamber 7, and the other may be used to recover the liquid from the pressure chamber 7. In this case, the recovered liquid may be circulated. In other words, the liquid in the pressure chamber may be used in a liquid ejection head with a configuration in which liquid is circulated between the pressure chamber and the outside. In such a liquid ejection head in which liquid is circulated, the distance between the plurality of protrusions 11 can be made relatively small, which is particularly effective in reducing satellite droplets and mist.

For example, in the above embodiments, a pair of protrusions 11 are formed on the inner surface of each ejection port 9. However, the present disclosure is not limited to the above example. For example, at least one protrusion 11 may be formed for each ejection port 9.

According to the various example embodiments of the disclosure, in a printing element substrate including a protrusion for preventing generation of mist, breakage of the protrusion can be prevented, and liquid droplets and foreign substances adhering to the outer periphery of the ejection port can be removed.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2016-106222 filed May 27, 2016, which is hereby incorporated by reference herein in its entirety.

What is claimed is:

1. A printing element substrate comprising:

a substrate;

an energy generating element disposed on one surface of the substrate and configured to generate energy for use in ejecting liquid;

an ejection-port formed member disposed on other portions of the one surface of the substrate, the ejection-port formed member including ejection ports defined by an outer periphery that eject the liquid; and at least one protrusion, formed from the ejection-port formed member, provided on the outer periphery of each the ejection ports such that the at least one protrusion protrudes towards a center of each respective ejection port, wherein each protrusion has a thickness defined by (1) an inner protrusion surface positioned above a pressure chamber formed between the one surface of the substrate and the inner protrusion surface and (2) an opposing exterior surface of the ejection-port formed member, wherein each protrusion has a distal tip portion configured such that both the inner protrusion surface and the opposing exterior surface of the distal tip portion are positioned closer to the substrate towards the center of each respective ejection port than the inner protrusion surface and the opposing exterior surface at the outer periphery of each respective ejection port.

2. The printing element substrate according to claim 1, wherein the ejection-port formed member has a thickness of 10 μm or less.

3. The printing element substrate according to claim 1, wherein a base portion of the at least one protrusion in contact with the inner protrusion surface is flush with the outer periphery.

4. The printing element substrate according to claim 3, wherein the ejection-port formed member comprises layers made of two kinds of material having different cure shrinkage characteristics.

5. The printing element substrate according to claim 1, wherein an entire length of the at least one protrusion is positioned closer to the substrate than the outer periphery.

6. The printing element substrate according to claim 1, wherein a length L of the at least one protrusion and a width D perpendicular to a direction in which the at least one protrusion extends satisfies a ratio L/D of 2 or higher.

7. The printing element substrate according to claim 1, wherein the at least one protrusion extends in a direction perpendicular to a direction in which the ejection ports are arranged.

8. The printing element substrate according to claim 1, wherein the at least one protrusion is smaller in a width of the tip portion than a width of a base portion in contact with the inner surface.

9. The printing element substrate according to claim 1, wherein the energy generating element is contained therein the pressure chamber, wherein the liquid in the pressure chamber is circulated between the pressure chamber and outside thereof.

10. The printing element substrate according to claim 1, wherein the at least one protrusion is angled inwards into the pressure chamber towards the energy generating element.

11. A liquid ejection head comprising:

a substrate;

an energy generating element disposed on one surface of the substrate and configured to generate energy for use in ejecting liquid;

an ejection-port formed member disposed on other portions of the one surface of the substrate, the ejection-port formed member including ejection ports defined by an outer periphery that eject the liquid; and at least one protrusion, formed from the ejection-port formed member, provided on the outer periphery of each the ejection ports such that the at least one protrusion protrudes towards a center of each respective ejection port, wherein each protrusion has a thickness defined by (1) an inner protrusion surface positioned above a pressure chamber formed between the one surface of the substrate and the inner protrusion surface and (2) an opposing exterior surface of the ejection-port formed member, wherein each protrusion has a distal tip portion configured such that both the inner protrusion surface and the opposing exterior surface of the distal tip portion are positioned closer to the substrate towards the center of each respective ejection port than the inner protrusion surface and the opposing exterior surface at the outer periphery of each respective ejection port.

12. The liquid ejection head according to claim 11, wherein the liquid comprises an ink having a coloring material concentration of 8.0% by weight or more.

13. The liquid ejection head according to claim 11, wherein a distance k between the tip portion of the at least one protrusion and the exterior surface of the ejection-port formed member satisfies $$k > \frac{5wL^4}{384EI}$$

where I is a second moment of inertia of a wiping member that moves on the exterior surface in a state of being in contact with the exterior surface, w is a load on the wiping member, E is Young's modulus of the wiping member, and L is a major axis of the ejection port.

14. The printing element substrate according to claim 11, wherein the at least one protrusion is angled inwards into the pressure chamber towards the energy generating element.

15. The liquid ejection head according to claim 11, wherein the liquid in the pressure chamber is circulated between the pressure chamber and outside thereof.

* * * * *